United States Patent [19]

Amosov et al.

[11] 4,075,028

[45] Feb. 21, 1978

[54] COMPOSITION FOR TREATING CELLULOSE-CONTAINING FIBROUS MATERIALS AND METHOD OF PRODUCING COMPOSITION FOR TREATING CELLULOSE-CONTAINING MATERIALS

[76] Inventors: Vladimir Alexandrovich Amosov, Nevsky prospekt, 96, kv. 122; Alexandr Evgenievich Guschin, Kovensky pereulok, 13, kv. 18; Jury Nikolaevich Efremov, Svetlanovsky prospekt, 99/2, kv. 42; Rudolf Evgenievich Smirnov, ulitsa Tverskaya, 20, kv. 142, all of Leningrad, U.S.S.R.

[21] Appl. No.: 679,483

[22] Filed: Apr. 22, 1976

[51] Int. Cl.[2] ..... C08L 1/08; C09J 3/04

[52] U.S. Cl. ..... 106/186; 106/169; 106/190; 106/194; 106/198; 162/158; 162/181 R; 162/181 A; 536/4; 536/30; 536/31; 536/56; 536/60

[58] Field of Search ..... 106/186, 169, 190, 194, 106/198; 162/158, 181 R, 181 A; 536/30, 31, 56, 60, 4

[56] References Cited

U.S. PATENT DOCUMENTS

| | | | |
|---|---|---|---|
| 2,129,708 | 9/1938 | Schreiber | 536/30 |
| 2,134,825 | 11/1938 | Hill et al. | 536/30 |
| 2,159,643 | 5/1939 | Weingand et al. | 536/30 |
| 2,234,889 | 3/1941 | Boulton et al. | 536/30 |
| 2,423,469 | 7/1947 | Schlosser et al. | 162/158 |
| 2,432,126 | 12/1947 | Schlosser et al. | 162/158 |
| 2,432,128 | 12/1947 | Schlosser et al. | 536/30 |
| 2,432,129 | 12/1947 | Schlosser et al. | 162/158 |
| 2,648,611 | 8/1953 | Richter | 106/186 |
| 3,084,092 | 4/1963 | Arlt | 162/158 R |

FOREIGN PATENT DOCUMENTS

| | | | |
|---|---|---|---|
| 841,256 | 7/1960 | United Kingdom | 162/158 |

OTHER PUBLICATIONS

Hagglund, "Chemistry of Wood" Academic Press 1951 pp. 39, 136–137, 349–358.

*Primary Examiner*—Herbert J. Lilling
*Attorney, Agent, or Firm*—Robert E. Burns; Emmanuel J. Lobato; Bruce L. Adams

[57] ABSTRACT

The composition proposed in the present invention is a cellulose gel consisting of no less than 13 wt.% of hemicelluloses in an aqueous solution of a compound selected from the group consisting of carbamide, thiocarbamide, alkyl-substituted thiocarbamide derivatives, sodium thiocyanate, sodium iodide, sodium perchlorate and mixture thereof.

According to the invention, said composition is subjected to beating in an aqueous solution of said compound to a beating degree of 0–1 units by the Canadian standard.

The present invention allows the elimination of neutralization and washing from the technological process of producing paper or non-woven material thus reducing considerably the duration of the technological cycle. The ultimate breaking strength for the end product is increased by 30% and the bursting strength of 20–30%.

8 Claims, No Drawings

COMPOSITION FOR TREATING CELLULOSE-CONTAINING FIBROUS MATERIALS AND METHOD OF PRODUCING COMPOSITION FOR TREATING CELLULOSE-CONTAINING MATERIALS

The present invention relates to manufacturing paper by the dry method and to compositions for treating cellulose-containing fibrous materials and methods of producing such compositions.

The present invention finds application in the dry method of paper production and the manufacture of glued non-woven material. Being introduced in amounts of 15–30% by weight of cellulose-containing fibres, the composition ensures a strong paper web with a closed (decreased porosity) structure made of a layer of dry fibres. Paper is produced by introducing the treating composition into the cellulose-containing fibrous material, pressing said fibrous material between rolls to remove excess binder and to make the paper compact in thickness, and drying, most often by contact, on the surface of the cylinders heated from the inside.

Known in the art is a composition for treating cellulose-containing fibrous materials containing a cellulose dispersion in the form of an alkaline solution of cellulose sodium xanthogenate (viscose). Said solution, being highly dispersed, possesses high penetrability towards fibrous materials and ensures a uniform impregnation of a fibre layer in producing paper by the dry method, and, consequently a paper web thus obtained displays homogeneous properties.

The production of the known composition includes 5–7 stages and resides in mercerization of the initial cellulose (treating with 17.5% sodium hydroxide), preageing (keeping in air), xanthation (treating with carbon disulphide), dissolution of the resulting xanthate in a water-alkaline solution, ageing (keeping of the solution obtained). The viscose produced for treating a fibrous layer contains highly toxic compounds, viz., carbon disulphide and hydrogen sulphide, and is an aggressive medium with an alkali concentration of up to 6%. Such a composition is costly and its application in paper production by the dry method and in manufacture of glued non-woven materials requires such operations as neutralization and washing, for example, on a papermaking machine. The prior-art method of producing a composition for treating a fibrous layer is disadvantageous in that it requires complex, special-purpose equipment (presses, mercerizors, dialyzers, xanthators, filter presses, rotating tubes), as well as highly toxic and explosion-hazardous compounds.

Also known in the art is a composition for treating cellulose-containing fibrous materials, which is a cellulose dispersion in an aqueous-alkaline solution of ferric sodium tartrate. 1000 ml of such a composition contain:

2–5 g of cellulose,
50–100 g of sodium hydroxide,
125–250 g of ferric sodium tartrate.

This known composition is prepared by successive dissolution in water of ferric sodium tartrate, sodium hydroxide, and cellulose. The positive feature of this known composition is a high degree of cellulose dispersion (a molecular solution or that of small associates of cellulose molecules) which ensures uniform impregnation of the fibrous material upon treatment and producing a sheet of paper with highly homogeneous properties. The disadvantages of this known composition are a high content of an alkali, which is toxic and corrosive; the high cost of the ferric sodium tartrate complex used in large amounts; under the conditions of using this composition there arises the necessity of neutralization and washing of the treated fibres.

It is an object of the invention to eliminate the above disadvantages.

It is an object of the invention to provide a composition for treating cellulose-containing fibrous materials, which will be neither toxic nor corrosive, being highly penetrable toward the fibrous material.

It is also an object of the invention to provide a composition for treating cellulose-containing fibrous materials, which will considerably reduce the duration of the technological process of producing a paper or non-woven materials.

A further object of the invention is to provide a composition for treating cellulose-containing fibrous materials, which will ensure improved physico-mechanical properties of paper or non-woven material.

Yet another object of the invention is to provide a method which will yield a non-toxic and noncorrosive composition for treating cellulose-containing fibrous materials, while considerably reducing the duration of the technological process of manufacturing paper or non-woven material possessing improved physico-mechanical properties.

Said objects are accomplished by the provision of a composition based on dispersed cellulose; as dispersed cellulose, according to the invention, said composition contains cellulose with no less than 13 wt.% of hemicelluloses in the form of a gel in an aqueous solution of carbamide, and/or thiocarbamide, and/or alkyl-substituted carbamide or thiocarbamide derivatives, sodium thiocyanate, sodium iodide, or sodium perchlorate. The proposed composition for treating cellulose-containing fibrous materials is neither toxic nor corrosive.

The proposed composition allows the elimination of neutralization and washing from the technological process of producing the paper or non-woven materials, while the ultimate breaking stress for the end product is increased by 30% and the bursting strength, by 20–30%.

The use of said cellulose allows the successful gelation of the initial cellulose, which ensures sufficiently high penetrability of the proposed composition towards fibrous material and endows the composition with adhesive properties. To ensure optimum conditions for treating cellulose-containing fibrous material and attain its best physico-mechanical properties, it is expedient, according to the present invention, that the composition should comprise the following components and in the following proportions:

cellulose — 0.1 –6 wt.%;
carbamide — 2–30 wt.%;
and/or thiocarbamide — 2–10 wt.%;
water — the balance.

An embodiment of the present invention resides in that the composition for treating cellulose-containing fibrous materials is obtained, according to the present invention, by beating cellulose with no less than 13 wt.% of hemicelluloses in a solution of carbamide and/or thiocarbamide, alkyl-substituted derivatives of carbamide and/or thiocarbamide, sodium thiocyanate, sodium iodide or sodium perchlorate to a beating degree of 0–1 units by the Canadian standard.

According to the present invention, it is expedient to carry out beating of cellulose in an aqueous solution containing 2–30 wt.% of carbamide and/or 2–10 wt.% of thiocarbamide, the concentration of unbleached cellulose in said solution being 0.1–6 wt.%.

The proposed method provides a noncorrosive and non-toxic composition for treating cellulose-containing fibrous materials which reduces considerably the duration of the technological process of producing paper or non-woven material, by eliminating the stages of neutralization and washing.

The proposed method also provides a composition which ensures improved physico-mechanical properties of the resulting paper or non-woven material. For instance, the ultimate breaking stress of the end material increases by 30% compared with that of the known material.

For a better understanding of other objects and advantages of the present invention a detailed description of the composition for treating cellulose-containing fibrous materials and the method of producing said composition as well as examples of realizing the invention are given hereinbelow by way of illustration.

A cellulose based composition for treating fibrous material must contain said cellulose in a highly dispersed state so that the composition be able to penetrate into the fibrous material upon treatment, for example, by impregnation, and be uniformly distributed in the material.

Thus, the best formulation of the composition are cellulose solutions where cellulose is dispersed to its molecular level.

However, the data on solvents for cellulose indicate that all the solvents used which are either strong alkalies or strong acids are toxic and corrosive compounds.

The proposed composition contains compounds favouring the swelling of cellulose in an aqueous medium, such as carbamide, thiocarbamide, methylcarbamide, ethylcarbamide, dimethylcarbamide, methylethylcarbamide or sodium thiocyanate, sodium iodide, sodium perchlorate.

The swelling of cellulose in water is, in general, an important stage and a prerequisite condition for the development of the of cellulose beating process. When beating is performed in an aqueous solution of a substance favouring the swelling of cellulose, the process of hydrobeating of cellulose is intensified and the cellulose is transformed into a gel-like state. However, in this case only such cellulose may be used which is adequate as to its ability of swelling in water and beatening. For example, unbleached cellulose containing no less than 13 wt.% of hemicelluloses meets these requirements.

The above-cited compounds (carbamide, thiocarbamide, their alkyl derivatives, sodium thiocyanate, sodium perchlorate, sodium iodide) are neutral and noncorrosive. There is no need to wash them off from paper web. At the same time the cellulose dispersity (a mobile gel being obtained as a result of beating) is sufficient for ensuring high penetrability into fibrous cellulose-containing materials. Thus, the proposed composition for treating cellulose-containing materials includes cellulose in a sufficiently dispersed state but is neutral, nontoxic, noncorrosive, and does not require washing off.

The proposed composition for treating fibrous cellulose-containing material contains as the mobile gel cellulose with no less than 13% of hemicelluloses which are cellulose companions in a wood cell similar, in general, to cellulose but differing from it in their polymerization degree and chemical structure (xylan, mannan, galactan); the composition also contains carbamide and/or thiocarbamide, and/or alkyl derivatives of said compounds, sodium thiocyanate, sodium iodide, or sodium perchlorate.

The treatment of fibrous material with the proposed composition is performed by impregnation or by application of the composition to the surface of the treated material by any known method. As is known, all the compositions used as binders are adhesives and bind the fibres in a web by depositing at their points of contact. An unbleached cellulose containing no less than 13 wt.% of hemicelluloses possesses high paper-forming properties (i.e. an ability to form a strong paper web from separate fibres). Due to the maximum hemicellulose content, such a cellulose is capable of strongly swelling in water and forming a sticky film on the surface of fibres, which ensures strong connection between the fibres in the paper web.

The cellulose in the proposed composition is a mobile gel (a liquid fluid jelly) containing 0.1–6.0% of cellulose and, which is expedient, 2–30% of carbamide (urea) and/or 2–10% of thiocarbamide (thiourea). The connection between the fibres is accomplished by the particles of the binder which form strong hydrogen bonds at the points of fibre contacts after compacting of the fibre layer of the cellulose-containing material on presses and drying. Compactness of the paper web is due to a high dispersity of cellulose entering into the treating composition, which ensures its penetration into the pores of the material, the pores being filled and "shrunk" after the drying. In case of carbamide and its derivatives, the composition contains neither electrolytes nor toxic substances, is neutral (pH=6.5–8.0), harmless from the standpoint of physiology, allows the elimination of neutralization and washing, and does not cause corrosion of the equipment.

The composition also contains 2–30% of carbamide and/or 2–10% of thiocarbamide necessary for the gelation of the cellulose as well as for the prevention of coagulation (precipitation of cellulose) and the improvement of wetting the fibres with the composition. The content of activators such as carbamide or thiocarbamide less than 2% concentration in the composition does not provide a required degree of cellulose dispersion thus complicating the penetration of the composition into the fibrous material. A content of carbamide of more than 30 wt.% (the maximum solubility of thiocarbamide is 10%) causes a very high carbamide content in the final material deteriorating its physico-mechanical properties.

The method of producing the composition for treating cellulose-containing fibrous material is realized as follows. Cellulose in the form of an aqueous suspension (1–6%) containing no less than 13 wt.% of hemicelluloses is subjected to beating by any known method, for example in a batch beater, the concentration of carbamide and/or thiocarbamide in the solution being 2–30% and 2–10%, respectively, until it is splitted into elementary fibrillas (the thread-like components of a fibre) and transformed into a gel (a beating degree 0–1.0 units according to the Canadian standard). The beating of cellulose is assisted by a plastisizing effect of an aqueous solution of carbamide (or thiocarbamide) as well as by hydrophilic properties of the initial cellulose (the ability to absorb water and to swell in water). Due to intensive beating under said conditions the cellulose swells considerably and transforms to a gel state. A high degree of dispersion and considerable hydration of the cellulose forming the composition make for the required adhesive properties of the composition and allow the treatment of fibrous materials in the process of the paper production by the dry method and non-woven material manufacture, by impregnation or application of the composition to one or two sides of the paper or non-woven web by any method known in the industry. The amount of the composition applied during the treatment depends on the requirements for the properties of the material, the mass per square meter, and the composition with respect to the fibre; it ranges from 15 to 35% of the weight of dry fibre.

The content of hemicelluloses less than 13% in the initial cellulose does not favour formation of mobile gel in the process of beating, which hinders the penetration of the composition into a fibre layer.

Carbamide and thiocarbamide entering into the proposed composition and playing an important part in realization of the method of its producing are hydrotropic agents which favour the swelling and dissolution in water of many hydrophilic high polymers weakening the intermolecular interaction in their structure. The compounds have 5-6 active sites which are able of forming hydrogen bonds (evidently first with water and then with the high polymer). This fact points to a change of the water structure in the solution of hydrotropes, which intensifies diffusion and reaction processes in such media in general. Carbamide and thiocarbamide are easily available (the world production of carbamide exceeds 10 million tons) which means that the proposed composition is economically expedient.

Thus, the proposed composition provides improved physico-mechanical properties of the paper web. Breaking length, which characterizes the resistance of paper to rupture, increases from 2,100 m for the cases when the known composition is used up to 3,200–3,500 m for the proposed composition. The bursting strength increases respectively from 1.8 kg/cm$^2$ up to 2.7 kg/cm$^2$. Under the conditions of using the proposed composition in the paper production by the dry method, the stages of neutralization and washing off toxic and corrosive compounds are eliminated, i.e. the duration of the technological process is reduced.

EXAMPLE 1

280 g of carbamide (urea) are dissolved in 3,720 ml of water and 80 g of unbleached cellulose containing 16.7% of hemicellulose are added to the solution obtained. Then, beating is performed in a laboratory beater for 50 minutes to a beating degree of 0 units by the Canadian standard. The cellulose gel formed as a result of the beating is diluted with water to a cellulose content of 0.6% and introduced into a dry layer of cotton fibres with an average length of 28 mm by impregnating the layer from two sides. After pressing the sample on felt between rolls under a pressure of 20 kg/cm$^2$ and drying on a heated roll at a surface temperature of 115° C, the material is obtained with breaking length of 3,200 m, bursting strength of 2.3 kg/cm$^2$, and density of 49 g/m$^2$, the content of the binder being about 25%.

EXAMPLE 2

280 g of thiocarbamide (thiourea) are dissolved in 3,720 ml of water and 80 g of unbleached cellulose containing 13.5% of hemicelluloses are added to the solution. Then beating is performed in a laboratory beater for 40–50 minutes to a beating degree of 0.2 units by the Canadian standard until a stable gel is formed. The gel is diluted with water to a cellulose content of 1.0% and introduced by impregnation into a dry layer of wood-cellulose fibres (from bleached sulphite process pulp) with an average length of 1.49 mm. The samples are pressed on felt between rubber-covered rolls under a pressure of 20 kg/cm$^2$ and dried on a heated cylinder at a surface temperature of 110° C. The paper produced has breaking length of 3,280 m, bursting strength (absolute) of 1.6 kg/cm$^2$, and density of 42 g/m$^2$, the content of the bender being about 25% by weight of the paper.

EXAMPLE 3

140 g of carbamide and 140 g of thiocarbamide are dissolved in 3,720 ml of water. 240 g of unbleached pulp containing 15% of hemicelluloses are introduced into the solution. Then, beating is performed in a laboratory Jokro mill for 60 minutes to a beating degree of 0 units by the Canadian standard until a stable gel is formed. The resulting composition is introduced into a layer of viscose fibres having an average length of 2.0 mm. The samples are pressed on felt between rubber covered rolls under a pressure of 20 kg/cm$^2$ and dried on a cylinder at 115° C.

The resultant material has a breaking length of 2,800, bursting strength of 2.7 kg/cm$^2$, and density of 97 g/m$^2$, the content of the binder being about 29% of the weight of the material.

EXAMPLE 4

The composition is obtained by following the procedure described in Example 1, beating being performed in a 2% carbamide solution with the following ratio of the components:

pulp containing 16.7% of hemicelluloses: 1.1%
carbamide: 2.0%
water: the balance.

The composition is introduced into a layer of wood-cellulose fibres having an average length of 1.49 mm. After the subsequent treatment by following the procedure described in Example 1 paper is produced with the following physico-mechanical properties:

breaking length of fracture: 2,910 m
bursting strength: 2.3 kg/cm$^2$
density: 101 g/m$^2$ with the binder content about 32% of the weight of the paper-web.

EXAMPLE 5

The composition is obtained by following the procedure described in Example 1, beating being performed in a 2% thiocarbamide solution with the following ratio of the components:

pulp containing 16.7% of hemicelluloses: 0.9%
thiocarbamide: 2.0%
water: balance.

The composition is introduced into a layer of wood-cellulose fibres having an average fibre length of 1.49 mm. After the subsequent treatment by following the procedure described in Example 1 paper is produced with the following properties:

density: 96 g/m²
breaking length: 2,980 m
bursting strength: 2.3 kg/cm² with the binder content about 35% of the weight of the paper web.

EXAMPLE 6

The composition is obtained by following the procedure described in Example 3 with the following ratio of the components:

pulpi 3.1%
thiocarbamide: 9.2%
water: the balance.

The composition is introduced into a layer of wood-cellulose fibres having an average length of 1.49 mm. After the subsequent treatment by following the procedure described in Example 1 paper is produced with the following properties:

mass of 1 m²: 100 g
breaking length: 3,200 m
bursting strength: 2.4 kg/cm² with the binder content about 32% of the paper weight.

EXAMPLE 7

The composition is obtained by following the procedure described in Example 1 with the following ratio of the components:

pulp: 1.0%
carbamide: 20%
thiocarbamide: 9.5%
water: the balance.

The composition is introduced into a layer of cotton fibres having an average length of 2.8 cm. After the subsequent treatment by following the procedure described in Example 1 paper is produced with the following properties:

mass of 1 m²: 98 g
breaking length: 3,300 m
bursting strength: 2.5 kg/cm² with the binder content of about 32% of the paper weight.

EXAMPLE 8

The composition is obtained by following the procedure described in Example 1, beating being performed in a 3% methylcarbamide solution, with the following ratio of the components:

pulp containing 16.7% of hemicelluloses: 0.6%
methylcarbamide: 3%
water: the balance.

The composition is introduced into a layer of cotton fibres having an average length of 2.8 cm. After the subsequent treatment by following the procedure described in Example 1, material is obtained with the following properties:

mass of 1 m²: 96 g
breaking length: 3,420 m
bursting strength: 2.6 kg/cm², the binder content in the resulting material being about 27%.

EXAMPLE 9

The composition is obtained by following the procedure described in Example 1, beating being performed in a 4% solution of dimethylthiourea (dimethylthiocarbamide), with the following ratio of the components:

pulp containing 16.7% of hemicelluloses: 0.6%
dimethylthiocarbamide: 4.0%
water: balance.

The composition is introduced into a layer of cotton fibres having a length of 2.8 mm and after the subsequent treatment following the procedure described in Example 1 material is obtained with the following properties:

mass of 1 m²: 99 g
breaking length: 3,240 m
bursting strength: 2.7 kg/cm², the binder content in the resulting material being about 35%.

EXAMPLE 10

The composition is obtained by following the procedure described in Example 1, beating being performed in a 3% sodium thiocyanate solution, with the following ratio of the components:

pulp containing 16.7% of hemicelluloses: 0.6%
sodium thiocyanate: 3%
water: the balance.

The composition is introduced into a layer of viscose fibres having a length of 20 mm and after the subsequent treatment by following the procedure described in Example 1 material is obtained with the following properties:

mass of 1 m²: 49 g
breaking length: 3,000 m
bursting strength: 1.7 kg/cm², the binder content in the resulting material being about 31%.

EXAMPLE 11

The composition obtained by following the procedure described in Example 1, beating being performed in a 3% sodium iodide solution, with the following ratio of the components:

pulp containing 16.7% of hemicelluloses: 0.6%
sodium iodide: 3%
water: the balance.

The composition is introduced into a layer of wood-cellulose fibres with an average length of 1.49 mm. After the subsequent treatment following the procedure described in Example 1, material is obtained with the following properties:

mass of 1 m²: 101 g
breaking length: 3,000 m
bursting strength: 2.5 kg/cm², the content of the binder being 25% of the weight of the material.

EXAMPLE 12

The composition is obtained by following the procedure described in Example 1, beating being performed in a 3% solution of sodium perchlorate, with the following ratio of the components:

pulp containing 16.7% of hemicelluloses: 0.6%
sodium perchlorate: 3%
water: the balance.

The composition is introduced into a layer of cotton fibres having a length of 2.8 cm. After the subsequent treatment by following the procedure described in Example 1 material is obtained with the following properties:

mass of 1 $m^2$: 100 g
breaking length: 2,800 m
bursting strength: 2.4 $kg/cm^2$, with the binder content of about 28% of the material weight.

What we claim is:

1. A composition for treating cellulose-containing fibrous materials containing cellulose with no less than 13 wt.% of hemicelluloses in the form of a gel in an aqueous solution of at least one compound selected from the group consisting of carbamide, thiocarbamide, alkyl-substituted derivatives of carbamide, and alkyl-substituted derivatives of thiocarbamide.

2. A composition for treating cellulose-containing fibrous materials as claimed in claim 1, wherein said composition consists of the following components in wt.%:

0.1–6: cellulose
2–30: carbamide
the balance being water.

3. A composition for treating cellulose-containing fibrous materials as claimed in claim 1, wherein said composition consists of the following components in wt.%:

0.1–6: cellulose
2–10: thiocarbamide
the balance being water.

4. A composition for treating cellulose-containing fibrous materials as claimed in claim 1, wherein said composition consists of the following components in wt.%:

0.1–6: cellulose
2–30: carbamide
2–10: thiocarbamide
the balance being water.

5. A method of producing a composition for treating cellulose-containing fibrous materials consisting of cellulose with no less than 13 wt.% of hemicelluloses in the form of a gel in an aqueous solution of at least one compound selected from the group consisting of carbamide, thiocarbamide, alkyl-substituted derivatives of carbamide, and alkyl-substituted derivatives of the thiocarbamide wherein cellulose containing no less than 13 wt.% of hemicelluloses is subjected to beating to a beating degree of 0-1 units by the Canadian standard in an aqueous solution of a compound selected from the group consisting of carbamide, thiocarbamide, alkyl-substituted derivatives of carbamide, alkyl-substituted derivatives of thiocarbamide.

6. A method of producing a composition for treating cellulose-containing fibrous materials as claimed in claim 1, wherein beating is performed in an aqueous solution containing 2–30 wt.% of carbamide, with the cellulose concentration in said solution being 0.1–6 wt.%.

7. A method of producing a composition for treating cellulose-containing fibrous materials as claimed in claim 6, wherein beating is performed in an aqueous solution containing 2–10 wt.% of thiocarbamide with the cellulose concentration in said solution being 0.1–6 wt.%.

8. A method of producing a composition for treating fibrous materials as claimed in claim 6, wherein beating is performed in an aqueous solution containing 2–30 wt.% of carbamide, 2–10 wt.% of thiocarbamide with the cellulose concentration in said solution being 0.1–6 wt.%.

* * * * *